United States Patent [19]

Visser

[11] 4,334,389

[45] Jun. 15, 1982

[54] PANEL WITH COUNTERWEIGHT

[75] Inventor: Frederiks T. L. Visser, Amersfoort, Netherlands

[73] Assignee: Poly-Pro, B.V., Maartensdijk, Netherlands

[21] Appl. No.: 129,256

[22] Filed: Mar. 11, 1980

[30] Foreign Application Priority Data

Mar. 13, 1979 [NL] Netherlands ..... 7901983

[51] Int. Cl.[3] ..... E05F 1/00

[52] U.S. Cl. ..... 49/387

[58] Field of Search ..... 49/387, 386, 197, 200

[56] References Cited

U.S. PATENT DOCUMENTS

| | | | |
|---|---|---|---|
| 1,253,302 | 1/1918 | Tomkinson | 49/387 X |
| 1,947,691 | 2/1934 | Baldwin et al. . | |
| 1,956,269 | 4/1934 | Canavan | 49/386 |
| 1,994,785 | 3/1935 | Premo . | |

FOREIGN PATENT DOCUMENTS

| | | | |
|---|---|---|---|
| 677070 | 6/1939 | Fed. Rep. of Germany . | |
| 746119 | 5/1933 | France | 49/387 |
| 1467870 | 12/1966 | France . | |
| 312084 | 6/1969 | Sweden | 49/197 |
| 407683 | 3/1934 | United Kingdom | 49/387 |

*Primary Examiner*—Philip C. Kannan

[57] ABSTRACT

A panel with a counterweight for opening and closing and/or bridging an opening or a space. In a preferred embodiment the construction is such that when the panel is in its closed position, the counterweight lies substantially in the same plane as the panel and relative to the pivot the counterweight extends in opposite direction to the panel; when the panel is in the open position, the counterweight lies mainly in the same plane as the panel and relative to the pivot said counterweight extends in the same direction as the panel.

6 Claims, 4 Drawing Figures

PANEL WITH COUNTERWEIGHT

The present invention relates to a panel comprising a counterweight for opening and closing and/or bridging an opening or a space.

Panels of this kind are known in various embodiments, such as floor or bottom panels, in which the panel closes or bridges an opening, or as wall panels for closing an opening in a wall. The counterweight may consist of one or more springs or of a body. The springs or the body exert a force on the panel such that said panel can easily be opened and/or closed by personnel.

When the counterweight is not directly connected to the panel, in most cases the connection between the panel and the counterweight is made with the aid of transmitting elements consisting of bars or levers which are pivoted or not pivoted and/or consisting of flexible elements, such as cables or chains. As examples are mentioned: bascule bridge roads, overhead doors, hatches in ceilings and in floors.

It can be required that the panel closing or bridging the opening from one side does not project into the space to be closed or bridged. In the case of an opening which has to be closed, the panel is with its top edge for instance pivoted to the downwardly directed upper edge of the fixed structure present around the opening to be closed or bridged; said structure here simply is called a frame. A panel of this kind is known e.g. from French Pat. No. 560,071 and from U.S. Pat. No. 1,524,956. Said known structures are highly complicated and they take up a good deal of space in the room to be closed. Thus, this room cannot be used completely. Both in open as in closed position the panel remains outside the space to be closed. It is the object of this invention to overcome the difficulties with known devices by providing a construction, in which the panel, the counterweight and the connection between the panel and the counterweight remains outside the space to be closed, i.e. in such a way that both in its open as in its closed position the panel and structural elements of the counterweight will not form an obstacle.

In accordance with the invention, this object is achieved by the panel being pivoted to a structure defining part of the circumference of the opening, and by providing at the side facing away from the space to be closed or bridged a member which is rigidly connected to the panel and which extends a distance from the face of the panel one end of a flexible element is connected to said member and the other end of the flexible element is connected to said circumferential part at a fixed point. Between both its ends said flexible element is secured to a guide means mounted on a portion of the counterweight which, in turn, is pivoted via a bar to or in the proximity of the pivot of the panel and to a guide means disposed on said circumferential part.

In order to make the construction of the panel not too heavy and, yet, rigid enough it is known from the above mentioned patents to reinforce the panel with one or more trussed reinforcing members positioned perpendicular to the plane of the panel; in accordance with said French patent, said reinforcing members are provided on the outer side of the panel. Each one of the reinforcing members is preferably embodied in the above member that extends a distance from the surface of the panel.

The construction is preferably embodied in such a way that when the panel is in its closed position, the counterweight lies mainly in the same plane as the panel and relative to the pivot said counterweight extends in opposite direction of the panel; when said panel is in the open position, the counterweight lies mainly in the same plane as the door section and relative to the pivot said counterweight extends in the same direction as the panel. As a result of this construction of panel and counterweight, the angle between the panel and the counterweight decreases from approx. 180° to approx. 0° when the panel is opened, the apex of the angle lies at or near the pivot joint of the panel and of the counterweight, and when said panel is closed said angle will increase from approx. 0° to approx. 180°. In closed position the panel and the counterweight lie approximately in one plane on either side of the pivot joint and in open position said panel and counterweight lie in the same plane on one side of the pivot joint; in the latter position they (panel and counterweight) are almost perpendicular to the plane of the opening to be closed. It is evident that in this construction not a single portion of the panel and of the counterweight lies inside the space to be closed and opened.

In accordance with a preferred embodiment the counterweight comprises a body that is mounted on the connection between the legs of a U-shaped element, the free leg ends of said element being pivoted to the same structure enclosing the opening as the panel.

In order to avoid that the counterweight in open position of the panel contacts said panel, it is preferred to provide a stop for the counterweight. In a simple manner said stop can be constituted by a flexible element with a fixed length, one end of said element being connected to the fixed structure enclosing the opening and the other end being secured to the counterweight.

The invention will now be described more in detail with reference to the accompanying drawing in which an embodiment of a panel for closing an opening in a wall is shown. In the drawing.

Figure 1:
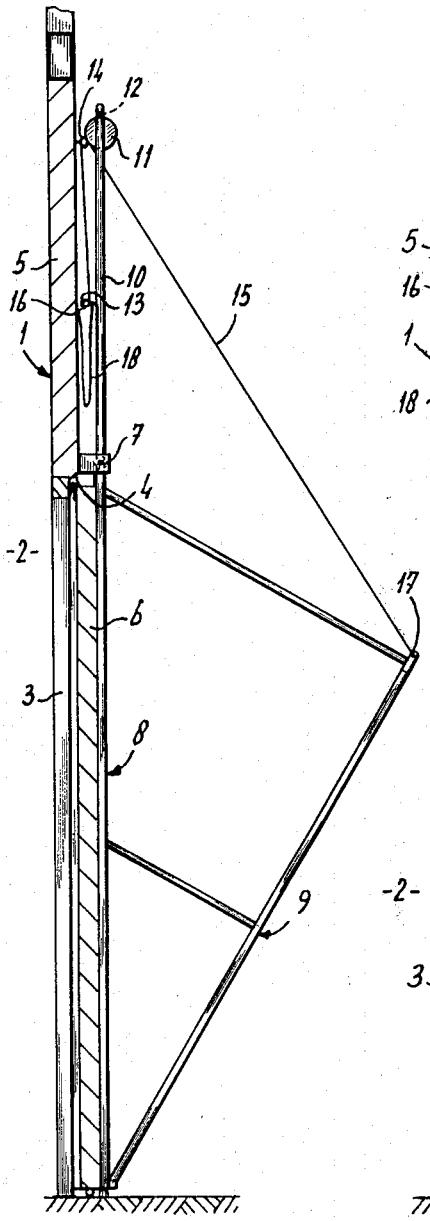
FIG. 1 is a side view of a vertical section of the panel in closed position.
Figure 2:
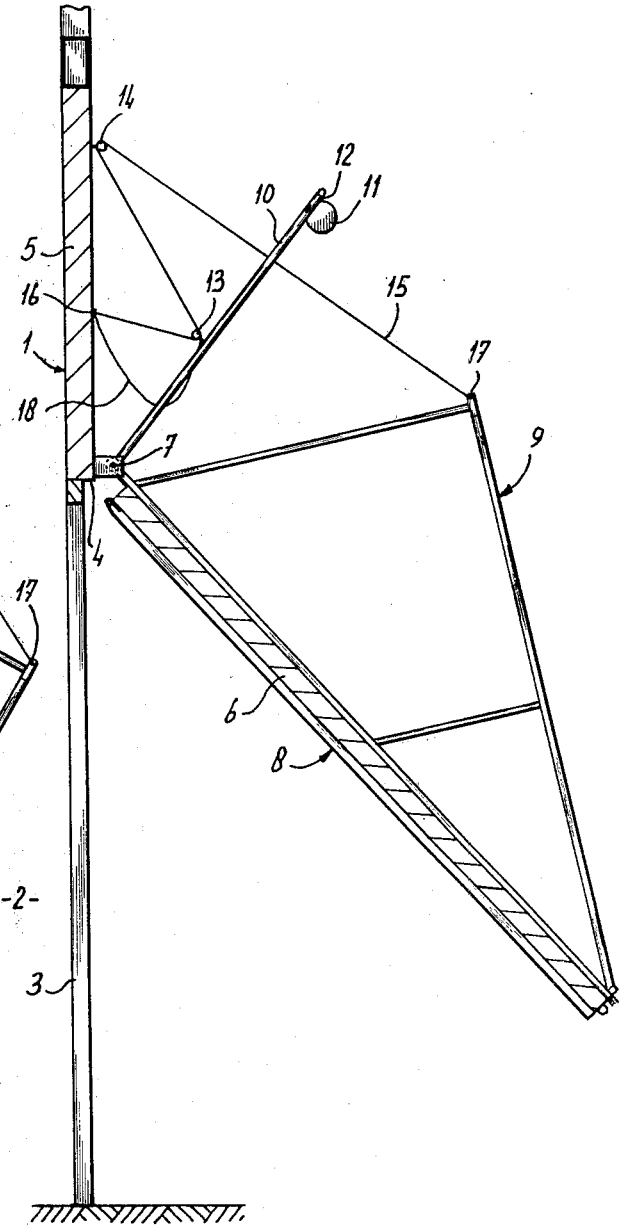
FIG. 2 illustrates the panel according to FIG. 1 in half-open position.

An opening 3 has been provided in wall 1 confining a space 2 (not illustrated). A panel 6 is pivoted at 7 to the lower edge 4 of the fixed structure 5 of the frame of the opening, said structure lying above the opening 3. The panel 6 may be similar to the one described in German Patent Publication (OS) No. 2,913,225 of Oct. 17, 1979 of the same Applicant.

The panel 6 is constituted by a closing section 8 and a trussed reinforcement 9 provided on the side which faces away from the opening to be closed.

One end of a bar 10 is pivoted to the same pivot joint 7 as panel 6; the other end of the bar is provided with a body that forms a counterweight 11. As illustrated in the drawing, the bar 10 and the counterweight are also pivoted together at 12. A guide means 13 is secured to the bar 10 at a point between both ends of said bar 10; a similar guide 14 is secured to the fixed structure 5 at a distance from the pivot joint 7. A flexible element, such as a cable 15, extends around guide means 13, 14; one end of the cable being secured to the fixed structure 5, as at 16, between the pivot joint 7 and the guide 14. The other end of the cable is secured to the top 17 of the reinforcement 9. A cable 18 is secured at 16 and to the guide means 13; the length of this cable is chosen such that the counterweight 11 will not contact the panel 6.

Figure 3:
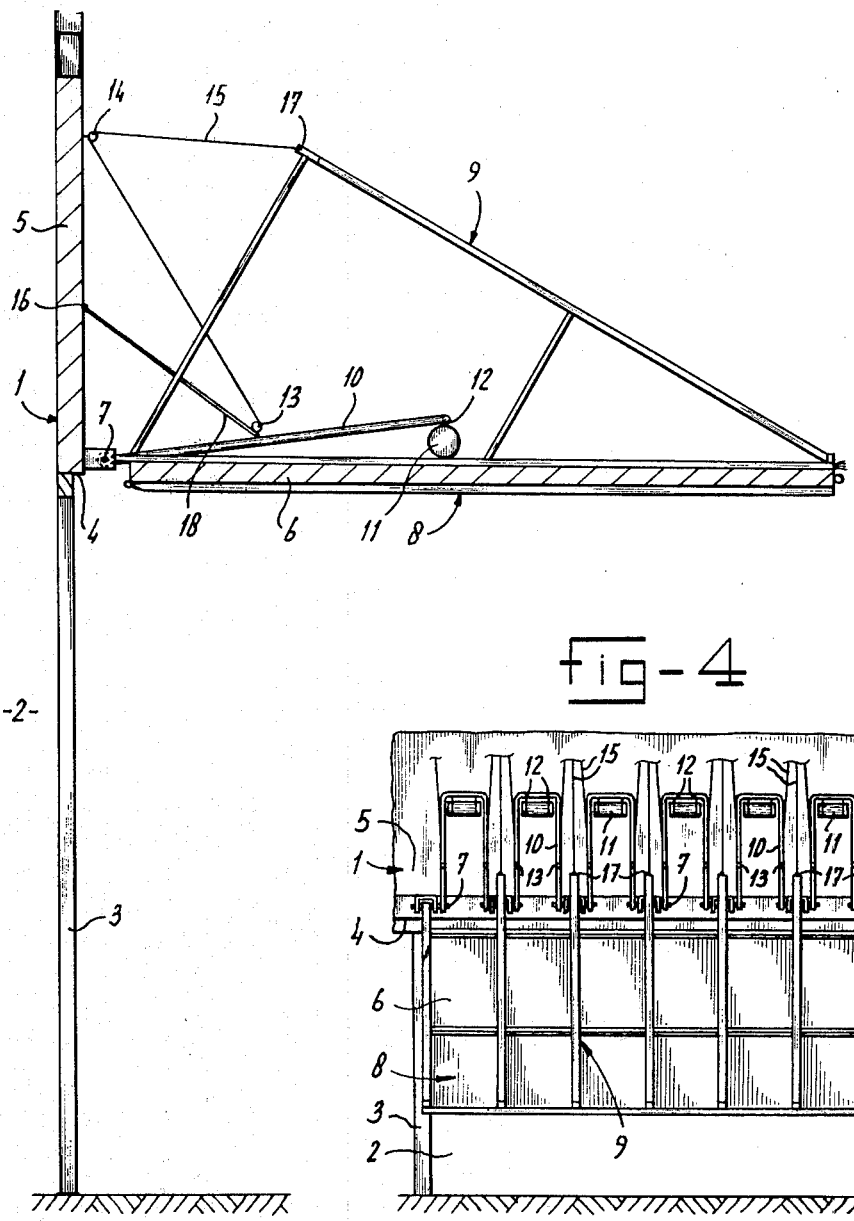
FIG. 3 illustrates the panel according to FIG. 1 in open position.

It is evident that the right choice of the mass of the counterweight 11 and of the regions where the cable 15 is secured to or cooperates with the various parts makes it possible to move the panel with ease from its closed position (shown in FIG. 1) into its open position (shown in FIG. 3) and back again into closed position.

Figure 4:
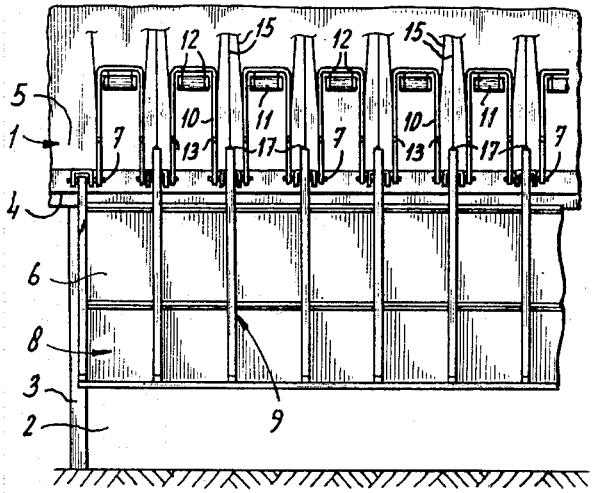
FIG. 4 is a front elevation of the panel according to FIG. 2.

As illustrated in FIG. 4, the connecton between pivot 7 and counterweight 11 is preferably U-shaped; each leg of the U-shaped connection constitutes a bar 10 and the counterweight 11 is provided on the connection between the legs of the U-shaped connection. In this way, a simple and reliable embodiment is obtained.

It is evident that the system according to the invention is applicable for many purposes, such as in bascule bridge roads, hatches in ceilings and in floors etc.

I claim:

1. In combination: a panel for opening and closing an opening surrounded by a structure defining a space, a pivot pivoting said panel to said structure at the side thereof facing away from the space, a member rigidly connected to said panel and extending a certain distance away from the surface of the panel, a flexible element one end of which is connected to said member and the other end of which is connected to said structure at a fixed point, a counterweight, bar means pivotally connecting said counterweight to said structure at or adjacent to said pivot, and two guide means, said flexible element being secured to said guide means intermediate its ends, one guide means being mounted on said bar and the other guide means being disposed on said structure.

2. The combination according to claim 1, wherein said member forms a part of a reinforcement of said panel.

3. The combination according to claim 1 or 2, wherein the counterweight comprises a U-shaped body provided with legs and a body between said legs, the free ends of said legs being pivoted to said structure.

4. The combination according to claim 1 or 2, comprising a stop for the counterweight preventing contact of the panel and counterweight when said panel is in the position opening the opening.

5. The combination according to claim 1 or 2, wherein said structure is such that when the panel is in the position closing the opening, the counterweight lies substantially in the same plane as the panel and relative to said pivot said counterweight extends in a direction opposite to said panel; and when said panel is in the position opening the opening, the counterweight lies essentially in the same plane as the panel and relative to the pivot said counterweight extends in the same direction as the panel.

6. The combination according to claim 5, wherein the counterweight comprises a U-shaped body provided with legs and a body between said legs, the free ends of said legs being pivoted to said structure.

* * * * *